United States Patent [19]

Roberts

[11] 4,347,206

[45] * Aug. 31, 1982

[54] METHOD OF EXTRUDING POLYPROPYLENE YARN

[75] Inventor: John S. Roberts, Howell, N.J.

[73] Assignee: Kling-Tecs, Inc., Mantoloking, N.J.

[ * ] Notice: The portion of the term of this patent subsequent to Dec. 1, 1998, has been disclaimed.

[21] Appl. No.: 229,012

[22] Filed: Jan. 27, 1981

Related U.S. Application Data

[63] Continuation-in-part of Ser. No. 127,360, Mar. 15, 1980, Pat. No. 4,303,606, which is a continuation of Ser. No. 893,371, Apr. 4, 1978, Pat. No. 4,193,961.

[51] Int. Cl.[3] ..... D01D 5/12

[52] U.S. Cl. ..... 264/176 F; 264/210.8; 264/234

[58] Field of Search ..... 264/176 F, 210.8, 234

[56] References Cited

U.S. PATENT DOCUMENTS

| | | | |
|---|---|---|---|
| 2,947,598 | 8/1960 | Maragliano et al. | 264/176 F |
| 3,435,108 | 3/1969 | Hendry | 264/176 F |
| 3,437,725 | 4/1969 | Pierce | 264/176 F |
| 3,686,049 | 8/1972 | Manner et al. | 264/176 F |

*Primary Examiner*—Jay H. Woo

*Attorney, Agent, or Firm*—Edward D. C. Bartlett

[57] ABSTRACT

A method of extruding polypropylene filaments in which the polypropylene is extruded at a temperature below 375° F., such as in the range 335° F. to 365° F., particularly about 350° F., into a quiescent hot zone having a temperature sufficiently high to retard cooling of the extruded polypropylene filaments. The filaments are then passed through and cooled in a quench zone across which cooling air is blown. The polypropylene has a narrow molecular weight distribution with a swell value less than 2.5, and its melt flow may be greater than 30. The yarn is drawn-down in the hot zone and the filaments may be drawn-down to an undrawn denier of less than 15 with substantial elimination of resonance.

16 Claims, 5 Drawing Figures

11
12
14
16
15
10
13a
13b
13c
13d
17
19
18
22
20
21
2
3
3
23
34
25
24
35
36
26
41
2
37
28
38
39
43
47
48
49
29
30

METHOD OF EXTRUDING POLYPROPYLENE YARN

RELATED APPLICATIONS

This application is a continuation-in-part of co-pending Application Ser. No. 127,360 filed Mar. 15, 1980 now U.S. Pat. No. 4,303,606, which is a continuation of Application Ser. No. 893,371 filed Apr. 4, 1978 and now issued as U.S. Pat. No. 4,193,961.

BACKGROUND OF THE INVENTION

Polypropylene yarns, particularly continuous filament textile face yarns, are usually produced with conventional "down-the-stack" air quench extrusion apparatus. These are housed in a building several stories high with an extruder on an upper floor, air quench cabinets on the floor below, and inter-floor tubes extending down to a lower floor where the yarn is taken up onto packages. Cooled air is blown through the quench cabinets to solidify and cool the yarn.

One disadvantage that occurs is resonance in the formation of the filaments of the yarn. As the polypropylene melt is extruded through a capillary in a spinnerette, it swells out on the underside of the spinnerette and then the filament is drawn-down from such swelling. However, this drawing-down occurs non-uniformly and, in exaggeration, the filament forms like a string of sausage links: this is resonance. Subsequently, when the filaments are being fully drawn, this resonance tends to cause draw breaks in the filaments. The more pronounced the resonance, the greater the frequency of draw breaks.

Also, the point at which a filament completes its drawing-down, in the quench cabinet, to its undrawn denier varies. This can be seen as a rain drop effect when looking into the quench cabinet. This contributes to further non-uniformity.

The temperature at which the polypropylene melt is extruded is usually of the order of 500° F., although lower temperatures have been tried. It is known that, in general, as the temperature is lowered, the swell on the underside of the spinnerette gets greater with an increase in resonance, and even the occurrence of spin breaks at or near the spinnerette face.

The problem of resonance and subsequent draw breaks gets more acute with finer denier per filament yarns, for example, yarns having an undrawn denier per filament less than 30, say less than 10 denier per filament in the finally drawn yarn, and more particularly with filaments having an undrawn denier less than 15. Also, with finer denier yarns the problem of denier variation from filament to filament, as well as along the length of the filament, becomes more noticeable.

SUMMARY OF THE INVENTION

The invention is based upon the realization that if the filaments are extruded into a relatively short hot zone, at or slightly below the temperature of extrusion, before they are contacted by the cooling air, then the extrusion temperature can be decreased without the usual increase in the volume of swell at the spinnerette face. It has been found that as the extrusion temperature decreases the resonance in the filaments decreases; an optimum point appears to be reached around 400° F. When the temperature goes much lower than this optimum point, resonance appears to start increasing again and then spin breaks occur. The precise optimum point is believed to be influenced by the swell value of the polypropylene and its melt flow. It is theorized that as the temperature of the melt decreases, the melt becomes more Newtonian in its behavior; this is believed to be further helped as the swell value of the polypropylene is decreased, for example to below 2.5.

It has been discovered that when the extrusion temperature is dropped sufficiently below the region of 400° F., the extrusion process stabilizes and unexpectedly uniform yarn can be produced. It has been discovered that this is helped by using polypropylene having a narrow molecular weight distribution with a low swell value, preferably less than 2.

Accordingly, it is an object of this invention to provide a method of producing polypropylene yarn having a high degree of uniformity.

It is yet another object of this invention to provide a method of extruding polypropylene yarn below 400° F.

Towards the accomplishment of the aforementioned objects and others which will become apparent from the following description and accompanying drawings, there is disclosed a method of producing a polypropylene filament in which polypropylene having a narrow molecular weight distribution with a swell value less than 2.5 is extruded at a temperature less than 375° F. The filament is passed through a hot zone to retard cooling of the extruded filament. The filament is drawn-down, or elongated, by a predetermined ratio while in the hot zone to determine its undrawn denier. It is then passed through a quenching zone to cool the filament. The polypropylene preferably has a melt flow greater than 30, for example, greater than 35. The melt flow may be in the range 35 to 45; it may be greater than 40. The swell value of the polypropylene is preferably less than 2, such as in the range 1.2 to 1.7. Even more preferably the swell value is less than 1.5.

The extrusion temperature is preferably in the range 335° F. to 365° F., for example, in the range 350° F. to 360° F.

The hot zone is preferably relatively short in relation to the quench zone, for example, the hot zone may be less than 2 feet in length. The hot zone preferably contains quiescent air or gas.

The characteristics of the polypropylene, the temperature of extrusion, the temperature and length of the hot zone, and the ratio by which the filament is drawn-down, or elongated, interact to retain the drawing-down, or elongating, in the hot zone and reduce the occurrence of resonance in the filament.

The filament may be cooled in the quenching zone by directing cooling air or gas over it.

The temperature of said hot zone may be below that at which the filaments are extruded but sufficiently high to retard cooling of the filaments. This temperature may be less than 70° F., or even 60° F., below the temperature of extrusion.

The filament may be drawn-down, or elongated, in the hot zone to an undrawn denier of less than 15, for example less than 10.

A plurality of filaments may be simultaneously extruded to produce one or more multi-filament yarns.

The present invention further provides a method of producing a multi-filament polypropylene yarn, comprising heating polypropylene having a swell value in the range 1.2 to 1.7 to a temperature in the range 350° F. to 360° F. at which it is molten, extruding the molten polypropylene into a plurality of filaments, passing the filaments through a first zone having a temperature sufficiently high to prevent substantially cooling the filaments therein, then passing the filaments through a second zone, and directing gas over the filaments in said second zone to cool them.

Specific embodiments of the invention will now be described in greater detail with reference to the accompanying drawings.

DESCRIPTION OF PREFERRED EMBODIMENTS

Figure 1:
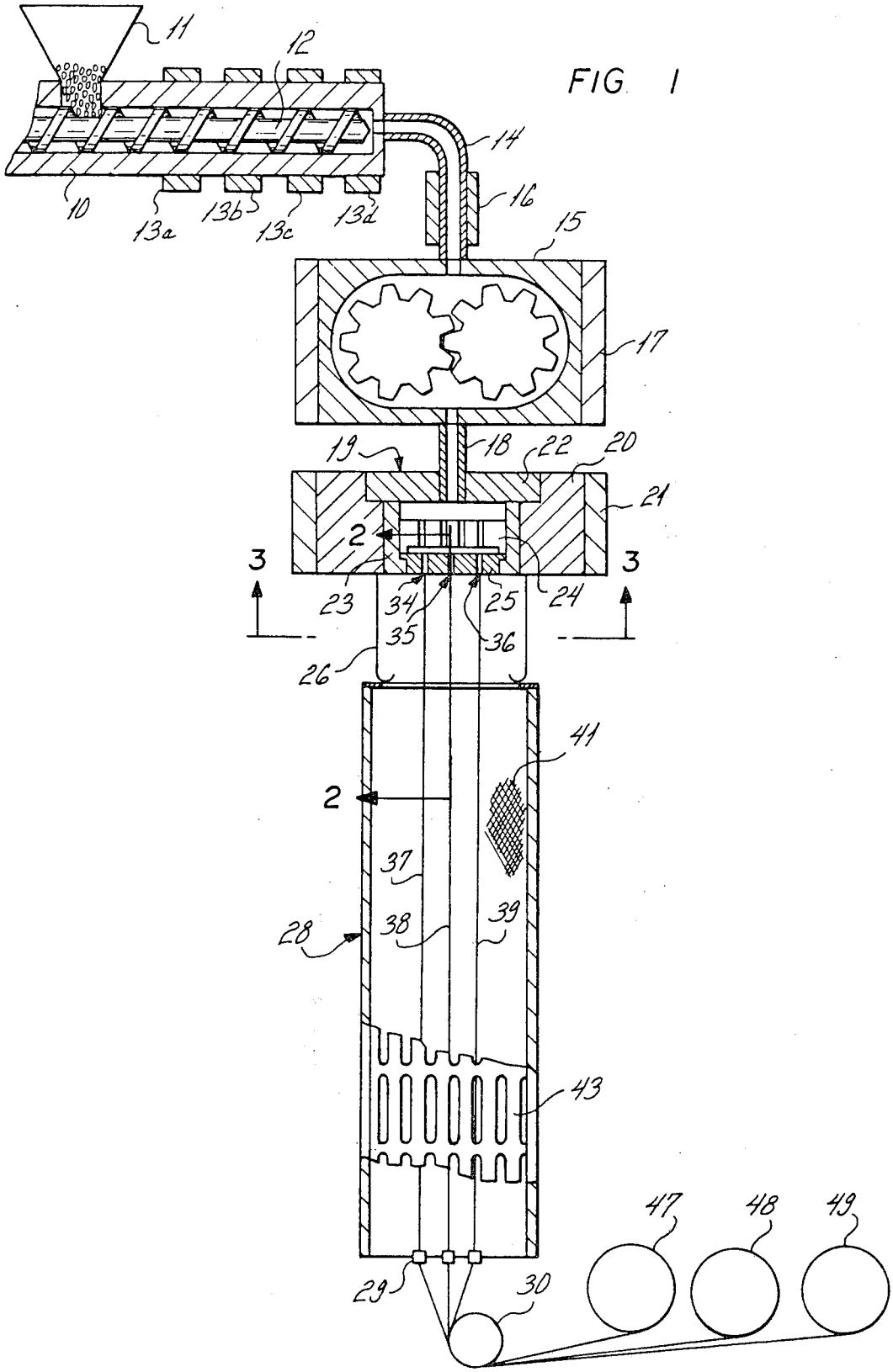
FIG. 1 is a schematic vertical section of an apparatus for carrying out the method of the invention.

In FIG. 1 an extruder 10 has an infeed hopper 11, a screw 12, and band heaters 13*a*, 13*b*, 13*c*, and 13*d*. A transfer tube 14 connects the discharge end of the extruder 10 to a metering pump 15. The transfer tube 14 and the metering pump 15 are surrounded by band heaters 16 and 17, respectively. The discharge side of the metering pump 15 is connected by a tube 18 to a spin pack 19 mounted in a spin block 20 which is surrounded by a band heater 21. The spin pack 19 has a cover plate 22, a body 23, a breaker plate 24, and a spinnerette 25. For simplicity, the usual heat insulation that covers the band heaters and other parts of the apparatus is not shown. A shroud 26 is attached by bolts 27 (see FIG. 2) to the underside of the spin block 20. Below the shroud 26 is mounted an air quench cabinet 28 at the bottom of which are finish applying guides 29. Just below the guides 29 is a denier control roll 30.

Figure 3:
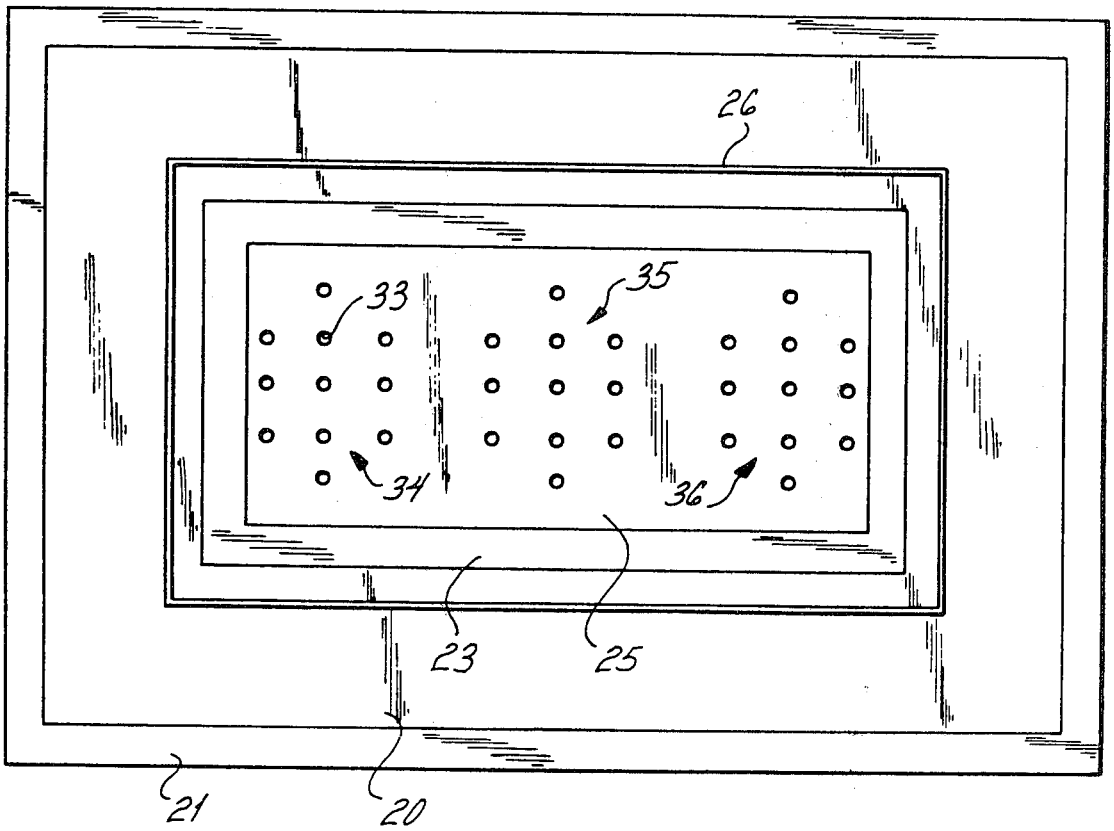
FIG. 3 is a diagrammatic sectional view on the line 3—3 of FIG. 1 but on approximately the same scale as FIG. 2.

The shroud 26 defines a rectangle in horizontal section, see FIG. 3. At its upper end is a flange 31 through which the bolts 27 pass. At the lower end of the shroud 26 is an inwardly directed collecting trough 32.

The spinnerette 25 has capillaries 33 arranged in three groups 34, 35, and 36, respectively, to produce three multifilament yarns 37, 38, and 39, respectively. To produce yarns having various filament counts, different spinnerettes can be used having a different number of capillaries.

The quench cabinet 28 has a top cover 40 which fits closely around the outside of the trough 32. One wall of the quench cabinet 28 is formed of wire mesh 41 supported in a frame 42. The opposite wall is formed of slotted sheet metal 43 supported in a frame 44. A cooling air plenum 45 registers with the wire mesh 41. In cross-section the quench cabinet is rectangular, similar to the shroud 26 and the face of the spinnerette 25 with the groups of capillaries 34, 35, and 36 spaced apart in a direction parallel to the longer sides of these rectangles.

Figure 2:
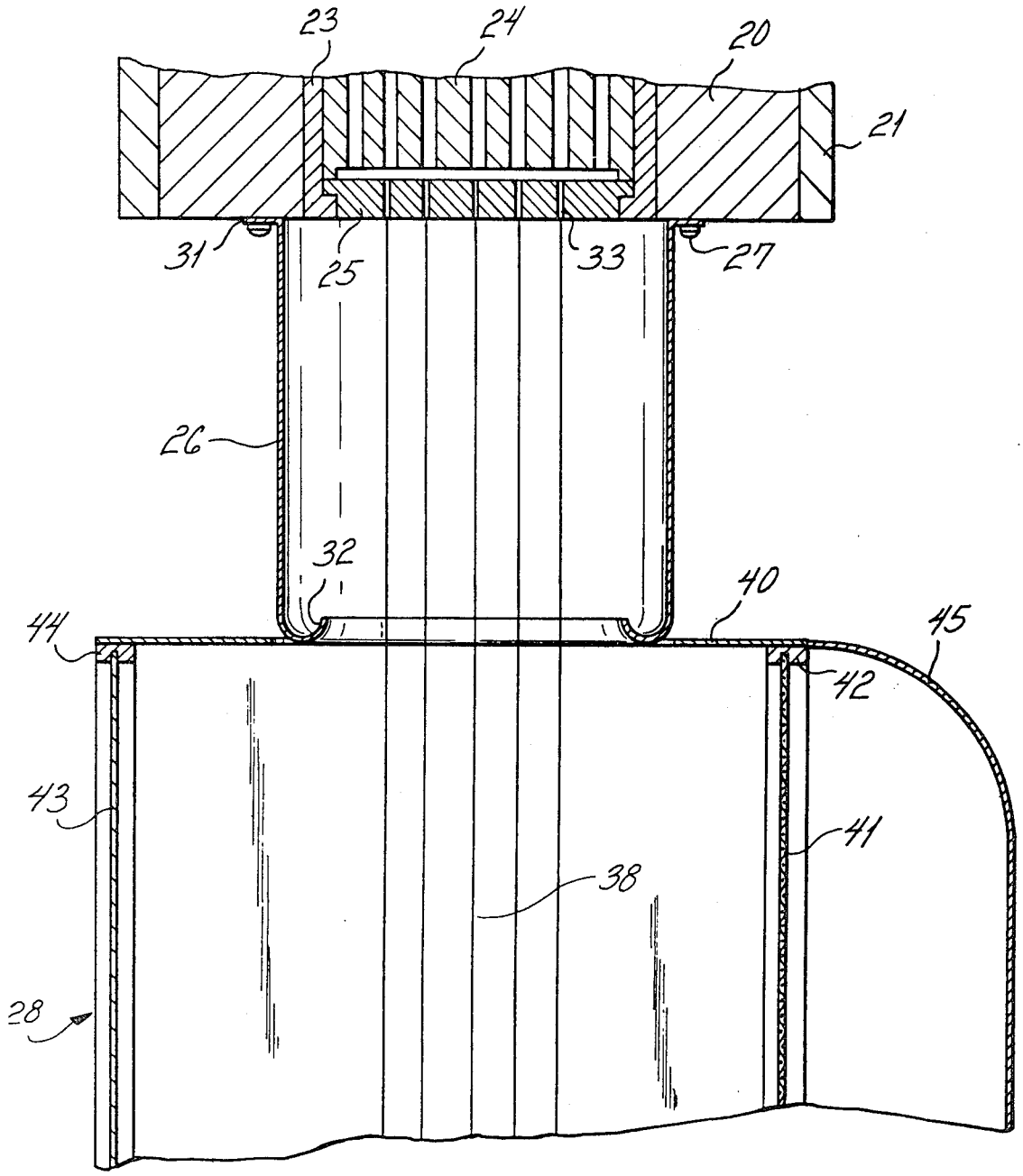
FIG. 2 is a diagrammatic section, on a larger scale, on the line 2—2 of FIG. 1.

The shroud 26 is relatively short and fits closely around the groups 34, 35, and 36 of capillaries but with sufficient clearance so that the yarns 37, 38, and 39, if they sway, do not come in contact with the inner edge of the trough 32. As seen in FIG. 3, the longer side of the shroud 26 is 12 inches and the shorter side 7 inches; the length of the face of the spinnerette 25 is 8 inches and the width 4 inches. The height of the shroud 26, as seen in FIG. 2, is 9 inches.

A more detailed description of an apparatus for carrying out the method of the invention is disclosed in U.S. Pat. No. 4,225,299 which is hereby incorporated by reference.

With the method according to the invention, pellets of polypropylene resin and pellets of color concentrate are fed via the hopper 11 into the extruder 10. The polypropylene has a narrow molecular weight distribution with a die swell or swell value below 2.5, preferably below 2. The resin and color are melted and heated by the extruder heaters to a temperature less than 375° F. and mixed by the screw 12. The heaters 13*a*, 13*b*, 13*c*, and 13*d* are set to control the temperatures of their zones. The downstream heaters 16, 17, 21 are set to control the temperatures of their zones. The melt is fed by the screw 12 through the transfer tube 14 to the metering pump 15 which delivers a metered stream of melt through the tube 18 to the spin pack 19. Inside the spin pack this metered stream is hydraulically split and extruded downwards through the capillaries 33 into the multitude of filaments forming the three spaced apart yarns 37, 38, and 39. The number of capillaries in the spinnerette is chosen to determine the number of filaments in each yarn. These yarns pass through the shroud 26, which defines a hot zone, and are then cooled as they pass through the quench cabinet 28. The cooling of the yarns is effected by blowing air at 100 to 200 feet per minute transversely across them, the air from the plenum 45 entering the quench cabinet through the wire mesh 41 and being exhausted to atmosphere through the slots in the sheet metal 43. The cooled yarns then pass through the guides 29 which apply spin finish to them before they are brought together around the denier control roll 30, after which the three yarns are separated and wound onto separate packages 47, 48, and 49. The denier control roll pulls the yarns down from the capillaries 33 at a controlled rate to determine their undrawn denier. This drawing-down of the filaments to their undrawn denier is arranged to occur in the shroud 26. Put another way, the extruded filaments are elongated by a predetermined ratio while in the hot zone to determine their undrawn denier.

The air inside the shroud 26 is trapped there and remains quiescent. This air is heated by the metal above it, namely the face of the spinnerette 25, the lower end of the pack body 23 and part of the spin block 20, these being heated by the spin block heater 21. The molten filaments leaving the capillaries 33 also heat this air. In this way, the air inside the shroud 26 remains hot at a temperature close to or just below, the temperature of the melt being extruded and prevents substantial cooling of the filaments as they pass therethrough, that is, the temperature in the shroud 26 is sufficiently high to retard cooling of the filaments. The temperature in the lower portion of the shroud 26 may be at a lower temperature than in the upper portion, but is sufficiently high to retard cooling of the filaments.

Figure 4:
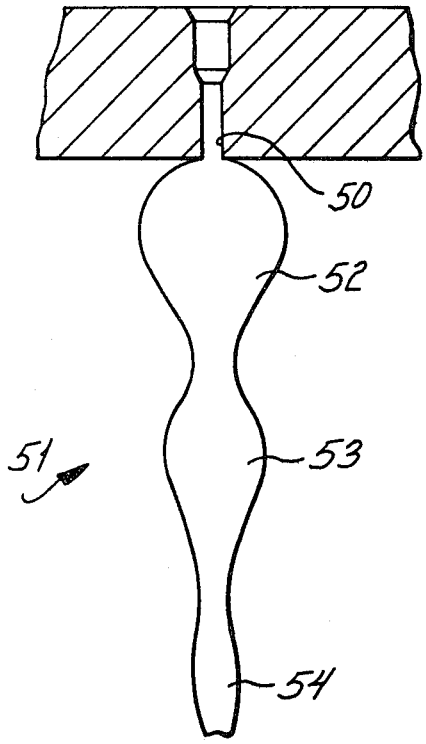
FIG. 4 is an illustration, on an enlarged scale, of a filament being produced non-uniformly.

FIG. 4 shows in an exaggerated manner a polypropylene filament being extruded from a capillary 50 directly into an air quenching zone 51 by a conventional air quench process. The molten polypropylene swells out at 52 under the face of the spinnerette and then forms a series of diminishing swellings 53, 54 before the draw-down to the size of the filament is completed. This series of swellings is not completely drawn out and results in the filament exhibiting resonance to some degree.

Figure 5:
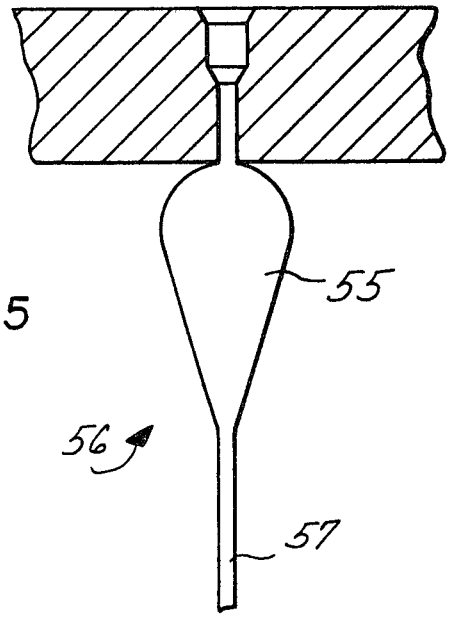
FIG. 5 is an illustration, on an enlarged scale, of another filament being produced uniformly.

FIG. 5 illustrates the way in which the swell draws-down in the present invention. An initial swell 55 occurs under the face of the spinnerette, but then due to the combination of the low temperature of extrusion and the extrusion of the filament into a hot quiescent zone 56, the draw-down, or elongation, occurs quicker over a shorter distance to a uniform filament 57. As can be seen, the total volume of the swell 55 is less than the volume of the elongated swell 52, 53, 54 shown in FIG. 4.

When 900 undrawn denier 70 filament yarn is produced by the method of the invention, and subsequently drawn at a draw ratio of, for example, 3:1 to a continuous filament nominal 300 denier 70 filament yarn, the yarn is uniform with substantially no resonance symptoms and has improved uniformity of denier from filament to filament. The yarn also draws with a high efficiency with substantially no draw breaks. This further makes possible multi-end drawing, for example, drawing four or eight yarns together on the same drawframe.

For the production of finer denier per filament yarns, it is preferable to use narrow molecular weight distribution polypropylene with a higher melt flow, for example, in the range 35 to 45, and with a lower swell value, for example, in the range 1.2 to 1.7. Also, a higher draw ratio, for example, 4:1 may be necessary.

Various examples of the method of the invention will now be described.

EXAMPLE 1

The heaters 13*a*, 13*b*, 13*c*, and 13*d* controlled the temperatures of their zones with temperature readings of 356° F., 354° F., 365° F., and 364° F., respectively. The downstream heaters 16, 17, and 21 were set to control their zones at 365° F., 365° F., and 365° F., respectively. The extruded polymer temperature was 365° F. Hercules Profax PC 961 polypropylene resin having a melt flow in the range 38–42 and a swell value in the range 1.2 to 1.7 was used. Ambient air was blown through the quench cabinet 28 at about 175 feet/minute with the slotted sheet metal 43 removed allowing the cooling air unrestricted direct discharge to atmosphere; this arrangement has been found to give more efficient cooling of the filaments without the filaments being disturbed. The metering pump 15 was set to deliver melt at the rate of 20 lbs. per spin pack 19. The denier control roll 30 was set to deliver the yarns 37, 38, and 39 at approximately 500 meters per minute. The multi-filament yarns produced had a filament count of 70 and an undrawn denier of 850. The yarns were subsequently multi-end drawn at a draw ratio of 3:1. The draw tension was 180 grams.

EXAMPLE 2

The zones 13*a*, 13*b*, 13*c*, and 13*d* had temperature readings of 352° F., 355° F., 364° F., and 362° F., respectively. The downstream heaters 16, 17, and 21 were set to control their zones at 365° F. The same polypropylene resin was used and the extrusion temperature was 362° F. Other conditions were similar to those in Example 1 with an adjustment to increase the undrawn denier of the extruded yarn to 1000. The yarns were subsequently multi-end drawn at a draw ratio of 4:1. The draw tension was 320 grams and 250/70 multi-filament drawn yarns were produced.

EXAMPLE 3

The zones 13*a*, 13*b*, 13*c*, and 13*d* had temperature readings of 340° F., 343° F., 345° F., and 351° F., respectively. The downstream heaters 16, 17, and 21 were set to 355° F., 365° F., and 365° F., respectively. The same polypropylene resin was used and the extrusion temperature was 351° F. Other conditions were similar to those in Example 2. The yarns were subsequently drawn at a draw ratio of 3.7:1. The draw tension was between 300 and 350 grams.

EXAMPLE 4

The zones 13*a*, 13*b*, 13*c*, and 13*d* had temperature readings of 341° F., 339° F., 354° F., and 343° F., respectively. The downstream heaters 16, 17, and 21 were set to 350° F., 365° F., and 365° F., respectively. The same polypropylene resin was used and the extrusion temperature was 343° F. Other conditions were similar to before. The yarns were subsequently drawn at a temperature of 180° F. and with a draw ratio of 4:1. Samples of these yarns were tested for uniformity on a Uster uniformity tester equipped with an integrator to measure %U, that is, integrated value of volume uniformity. The following readings were obtained:

First tube:

%U normal reading 1.7; 1.6; 1.65

%U ½ inert reading 1.4

Second tube:

%U normal reading 1.7; 1.8; 1.5

%U ½ inert reading 1.0

Many samples of the yarns produced similarly to Examples 1 through 4 were tested for uniformity on the Uster to measure %U. In general, the %U normal reading fell within the range 1.4 to 2.0. Similar measurements were made with samples of a highly successful, commercially available, 300 denier 72 filament drawn polypropylene multi-filament yarn, which is produced by conventional multi-story "down-the-stack" extrusion using normal extrusion temperatures; the %U normal reading fell within the range 2.5 to 3.5. Yarns produced by the method of the present invention have been found to have unexpectedly excellent uniformity.

Below is a chart summarizing the effect of extrusion temperature on the draw tensions obtained and the draw retios used with yarns produced in a similar manner to that hereinbefore described:

| Extrusion Temperature | Draw Tension | Draw Ratio |
|---|---|---|
| 400° F. | 400 grams | 3:1 |
| 380° F. | 275–325 grams | 3:1 |
| 365° F. | 180 grams | 4:1 |
| 362° F. | 320 grams | 3.7:1 |
| 350° F. | 300–350 grams | 4:1 |

Preferably, when drawing multi-filament polypropylene yarns, the draw tension should be from 1 to 1.2 grams per denier drawn. If this tension drops below 1 gram per denier, undrawn sections will occur. On the other hand, if this tension is increased much above 1.2 grams per denier, filament breakage will occur. The draw tension determines the draw ratio that can be used, and the extruded denier has to be adjusted to then give the final desired drawn denier. When producing multi-filament yarn in accordance with the invention disclosed in the grandparent application, now U.S. Pat. No. 4,193,961, it was found that as the extrusion temperature was dropped from about the 400°-410° F. range, the draw tension in subsequent drawing stayed about the same and rather high. Also, a draw ratio of about 3:1 had to be used. Between 400° and 380° F. the draw tension remained rather high. Then, unexpectedly, around 370° F. the draw tension suddenly dropped and drawing efficiency improved. The drop in tension was so significant that in the extrusion temperature range of 350° F. to 365° F., a draw ratio of about 4:1 could be employed with excellent drawing efficiency and with production of yarns having outstanding uniformity.

It is surprising to note that since crystalline isotactic polypropylene solidifies at about 330° F., multi-filament yarns extruded at temperatures so close to this solidification temperature are outstandingly uniform with no symptoms of resonance. In addition to improved uniformity, a second advantage is obtained by extruding at less than 375° F., namely, lower cost pigments and temperature sensitive pigments, for example, red iron oxide, can be used without any fear of being degraded by the temperature of extrusion. Also, it has been found that less percentage of color by volume is used with the process of the invention than would be anticipated for any particular denier count and construction; in particular this has been noticed when producing filaments having a modified cross-section of somewhat triangular shape. Another feature of polypropylene yarn produced by the invention is that no para-crystallinity is found in the yarn or filaments.

Narrow molecular weight distribution polypropylene is usually made by thermal degradation of reactor resin, although this can be done chemically. The object is to degrade the high molecular weight material. The swell value is the ratio of the diameter of the extrudate just below the face of the spinnerette divided by the diameter of the capillary through which it is being extruded. This should be measured using a capillary with basically zero land (length to radius ratio not greater than 0.221) at a temperature of 190° C. and at a shear rate of one thousandth of a second. Shear rate equals four times the volumetric flow rate (q in cubic centimeters per second) divided by $\pi$ times the third power of the capillary radius (in centimeters)

$$\text{i.e., Shear rate} = \frac{4q}{\pi \times \text{radius}^3}$$

The above described embodiments, of course, are not to be construed as limiting the breadth of the present invention. Modifications, and other alternative constructions, will be apparent which are within the spirit and scope of the invention as defined in the appended claims.

What is claimed is:

1. A method of producing a multi-filament polypropylene yarn, comprising:

heating polypropylene having a narrow molecular weight distribution with a swell value of less than 2.5 to a temperature at which it is molten;

extruding the molten polypropylene at a temperature less than 350° F. into a plurality of filaments;

passing the filaments through a first zone having a temperature sufficiently high to retard cooling of the filaments therein;

drawing-down the filaments to their undrawn denier in said first zone;

then passing the filaments through a second zone; and directing cooling gas over the filaments in said second zone to cool them;

the combination of the swell value of the polypropylene, the temperature of extrusion, and the temperature of said first zone interacting to substantially eliminate the occurrence of resonance in the filaments as they are drawn-down in said first zone.

2. A method of extruding a polypropylene filament, comprising:

extruding at a temperature less than 375° F. molten polypropylene having a swell value of less than 2.5 into a filament;

passing the filament through a hot zone to retard cooling of the filament;

drawing-down the filament to determine its undrawn denier while it is in said hot zone; and thereafter passing the filament through a quenching zone to substantially cool the filament.

3. A method of producing a polypropylene filament, comprising:

extruding at a temperature less than 375° F. molten polypropylene having a narrow molecular weight distribution with a swell value of less than 2.5 and a melt flow greater than 30 into a filament;

passing the filament through a hot zone to retard cooling of the extruded filament;

elongating the filament by a predetermined ratio while in said hot zone to determine its undrawn denier; and then passing the elongated filament through a quenching zone to cool the filament;

the characteristics of the polypropylene, the temperature of extrusion, the temperature and length of said hot zone, and the ratio by which said filament is elongated interacting to retain said elongating in said hot zone and reduce the occurrence of resonance in the filament.

4. The method recited in claim 3 in which said swell value is less than 2.

5. The method recited in claim 4 in which said melt flow is greater than 35.

6. The method recited in claim 5 in which said melt flow is greater than 40.

7. The method recited in claim 5 or 6 wherein said swell value is less than 1.5.

8. The method recited in claim 3 wherein cooling air is directed over the filament in said quenching zone to cool the filament.

9. The method recited in claim 8 wherein said hot zone is relatively short in relation to the length of said quenching zone and contains quiescent air.

10. A method of producing drawn multifilament polypropylene yarn, comprising:

extruding a plurality of filaments from molten polypropylene at a temperature in the range 335° F. to 365° F.;

said molten polypropylene having a narrow molecular weight distribution with a swell value of less than 2.5;

passing said filaments through a hot zone having a temperature below that at which the filaments are extruded but sufficiently high to retard cooling of the filaments;

elongating said filaments in said hot zone to determine the undrawn denier of said filaments before the latter leave said hot zone;

then cooling said elongated filaments; and subsequently drawing said filaments at a draw ratio of at least 3 to 1.

11. The method recited in claim 10 wherein said molten polypropylene has a melt flow greater than 35, said swell value is less than 1.7, the extrusion temperature is less than 365° F., and said draw ratio is at least 3.7 to 1.

12. The method recited in claim 11 wherein said hot zone contains quiescent air, and cooling air is directed transversely over the elongated filaments in a quench zone to effect said cooling.

13. The method recited in claim 12 in which said undrawn denier is less than 15 denier per filament.

14. The method recited in claim 13 in which said undrawn denier is less than 10 denier per filament.

15. A method of producing a multi-filament polypropylene yarn, comprising:

heating polypropylene having a swell value in the range 1.2 to 1.7 to a temperature in the range 350° F. to 360° F. at which it is molten;

extruding the molten polypropylene into a plurality of filaments;

passing the filaments through a first zone having a temperature sufficiently high to prevent substantially cooling the filaments therein;

then passing the filaments through a second zone; and directing gas over the filaments in said second zone to cool them.

16. The method recited in claim 15 in which said polypropylene has a melt flow in the range 35 to 45.

* * * * *